US006807786B1

(12) United States Patent
Peck

(10) Patent No.: US 6,807,786 B1
(45) Date of Patent: Oct. 26, 2004

(54) EXTERIOR WALL RESTORATION SYSTEM AND CONSTRUCTION METHOD

(75) Inventor: Dick Peck, Las Vegas, NV (US)

(73) Assignee: Stucco Restoration Systems Inc., Las Vegas, NV (US)

( * ) Notice: Subject to any disclaimer, the term of this patent is extended or adjusted under 35 U.S.C. 154(b) by 14 days.

(21) Appl. No.: 10/038,300

(22) Filed: Jan. 4, 2002

(51) Int. Cl.[7] ..... E04G 23/02

(52) U.S. Cl. ..... 52/514.5; 52/515; 52/741.14; 52/362; 52/454

(58) Field of Search ..... 52/514, 514.5, 52/515, 741.4, 741.41, 454, 361, 362, 363

(56) References Cited

U.S. PATENT DOCUMENTS

| | | | | |
|---|---|---|---|---|
| 1,541,360 | A | * | 6/1925 | Keas et al. |
| 1,711,928 | A | * | 5/1929 | Doucett et al. |
| 1,767,565 | A | * | 6/1930 | Thrift et al. |
| 2,643,539 | A | * | 6/1953 | Bouch |
| 4,311,656 | A | * | 1/1982 | Spriggs |
| 4,349,398 | A | * | 9/1982 | Kearns et al. |
| 4,392,335 | A | * | 7/1983 | Heiman ..... 52/309.17 |
| 4,434,597 | A | * | 3/1984 | Fischer |
| 4,460,420 | A | * | 7/1984 | Estrada |
| 4,558,552 | A | * | 12/1985 | Reitter |
| 4,653,243 | A | * | 3/1987 | Burkett |
| 4,852,316 | A | * | 8/1989 | Webb |
| 4,882,888 | A | * | 11/1989 | Moore |
| 5,269,861 | A | * | 12/1993 | Gilbreath |
| 5,410,852 | A | * | 5/1995 | Edgar et al. |
| 5,826,388 | A | * | 10/1998 | Irving |
| 5,925,204 | A | * | 7/1999 | Hoffmann |
| 5,979,131 | A | | 11/1999 | Remmele et al. |
| 6,355,333 | B1 | * | 3/2002 | Waggoner et al. |
| 6,363,679 | B1 | * | 4/2002 | Rutherford |

FOREIGN PATENT DOCUMENTS

| | | | |
|---|---|---|---|
| DE | 195 07 014 | 9/1996 | |
| FR | 2 194 208 | 2/1974 | |
| JP | 4-330148 | * 11/1992 | ..... E04F/13/02 |
| JP | 6-32396 | * 2/1994 | ..... B65D/90/06 |

OTHER PUBLICATIONS

Notification of Transmittal of the International Search Report or the Declaration, for PCT/US02/39550, dated Mar. 21, 2003.

* cited by examiner

*Primary Examiner*—Robert Canfield
(74) *Attorney, Agent, or Firm*—Quirk & Tratos

(57) ABSTRACT

An exterior wall restoration system is applied to an existing exterior wall construction in various layers. The wall restoration system can be utilized to cover damaged or defective wall systems without having to remove a substantial portion of the existing wall system. The wall restoration system includes a water resistant membrane layer, a reinforced cementatious base coat layer, a finish coat layer, a sealant layer, and a final coat layer—these layers are applied over the existing wall system.

11 Claims, 9 Drawing Sheets

EXTERIOR WALL RESTORATION SYSTEM AND CONSTRUCTION METHOD

FIELD OF THE INVENTION

The present invention relates generally to building construction. More particularly, the present invention relates to exterior wall construction techniques.

BACKGROUND OF THE INVENTION

The prior art is replete with exterior wall construction techniques, exterior wall systems, and materials and compositions used for exterior wall systems. The traditional exterior wall system is often referred to as a "three coat" plaster system (consisting of an underlying scratch coat, a brown coat applied over the scratch coat, and a finish coat applied over the brown coat). Alternatively, "one coat" systems are used in some geographical regions. These one coat systems typically utilize a foam insulation board as the underlying substrate (but may use other approved materials as the underlying substrate) and a base coat applied over the insulation board. Both of these common exterior wall systems are governed by various building and construction codes and regulations.

Construction defects, severe weather, and settling of the structure can crack or otherwise damage exterior wall systems. Although minor cracking and slight damage can be repaired with filler material or adhesive, extensive defects or major damage may require a significant amount of reworking. The most common prior art repair technique calls for the replacement of only the damaged portions of the wall system—the damaged materials are removed and reconstructed such that the repaired portion blends into the undamaged portion of the existing wall. While this technique may be appropriate for isolated damage to walls that are non-defective, it may not be effective to repair defective walls (which may continue to show signs of cracking or degradation). Furthermore, the replacement of large sections of an existing exterior wall system requires the removal of staples, nails, or other fasteners from the building framework. The removal of these fasteners can result in structural damage and/or interior drywall damage to the building.

BRIEF SUMMARY OF THE INVENTION

An exterior wall restoration system according to the present invention is applied over an existing wall system. The wall restoration system can be applied to existing one coat or three coat wall systems. The wall restoration system can be used to repair defective exterior wall systems without requiring the removal of large portions of the existing wall system. The wall restoration system can be used to repair known damage to an existing wall system and/or to restore and reinforce potentially defective wall systems.

The above and other aspects of the present invention may be carried out in one form by an exterior wall restoration system for application to an existing exterior wall surface. The exterior wall restoration system includes a water resistant membrane layer affixed to the existing exterior wall surface, a galvanized reinforcing element attached over the water resistant membrane layer, an acrylic base coat layer applied over the water resistant membrane layer and over the reinforcing element, a finish coat layer applied over the acrylic base coat layer, and a sealant layer formed over the finish coat layer.

BRIEF DESCRIPTION OF THE DRAWINGS

A more complete understanding of the present invention may be derived by referring to the detailed description and claims when considered in conjunction with the following Figures, wherein like reference numbers refer to similar elements throughout the Figures.

DETAILED DESCRIPTION OF A PREFERRED EMBODIMENT

The present invention relates to an exterior wall restoration system that is applied over an existing exterior wall construction. Although not a requirement of the invention, the exterior wall restoration system is particularly suited for use in connection with the repair or restoration of defective and/or damaged wall systems. The wall restoration system described herein can be utilized in combination with known exterior wall constructions, e.g., a one coat system, a three coat system, or the like, and the embodiments shown and described herein are merely illustrative examples. Furthermore, the figures are not to scale and the proportions of the various components shown in the figures may be exaggerated for the sake of clarity.

Figure 1:
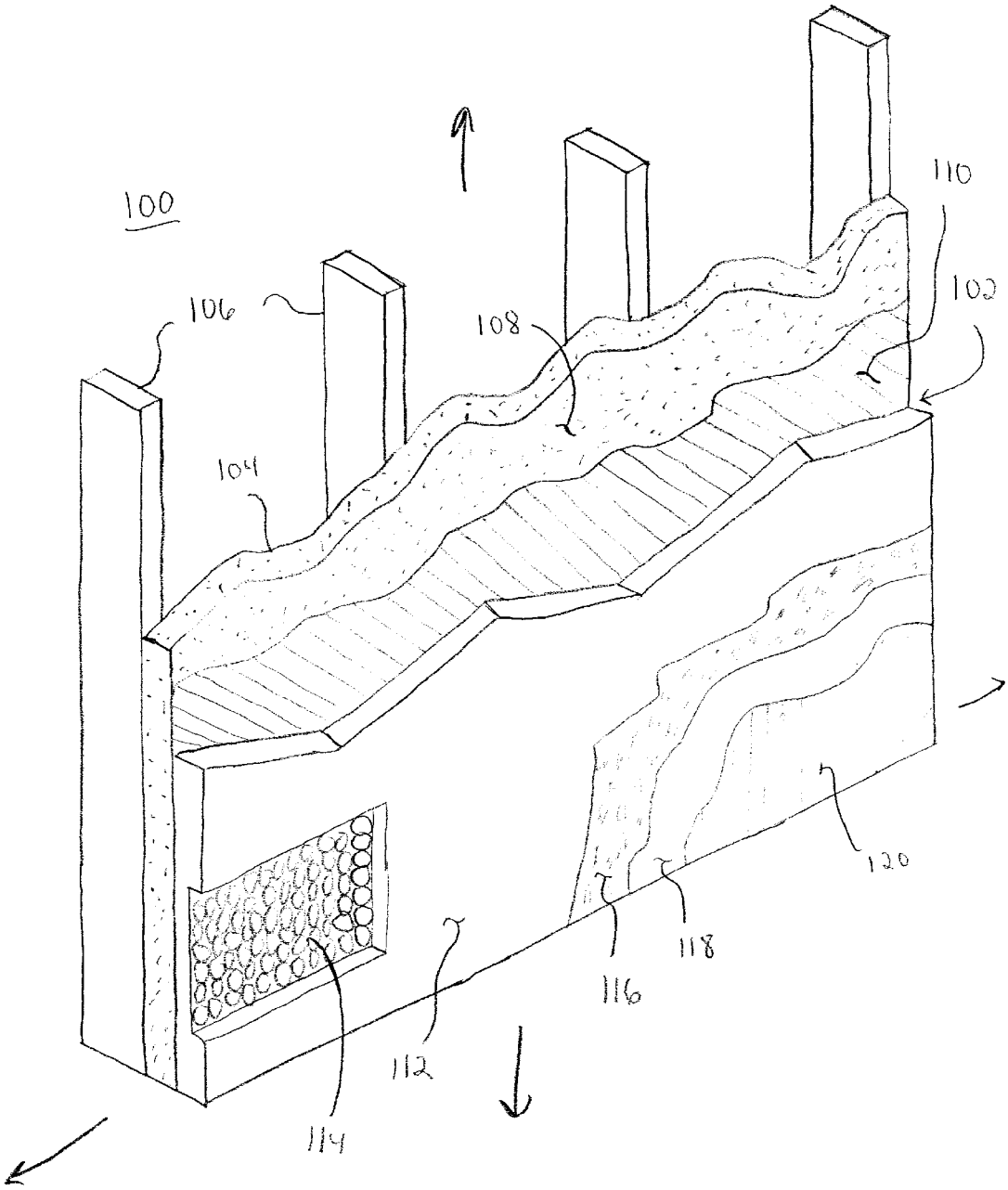
FIG. 1 is a perspective cut-away view of a section of an exterior wall system that includes a restoration system configured in accordance with the present invention.

FIG. 1 is a perspective cut-away-view of a section of an exterior wall system 100 that includes a restoration system 102 configured in accordance with the present invention. Exterior wall system 100 may be part of any structure, e.g., a residential or commercial building. For simplicity, exterior wall system 100 is depicted as a flat section having no door, window, or other discontinuity. However, those familiar with the construction of exterior wall systems will appreciate that the techniques of the present invention can be applied to contoured wall sections, cornered wall sections, wall sections having windows or doors, and the like.

Restoration system 102 is applied over an existing exterior wall system 104. As used herein, an existing exterior wall system refers to a wall construction previously applied to the exterior of the building. In this regard, existing exterior wall system 104 may utilize any number of known construction techniques, e.g., a one coat technique or a three coat technique, and any number of known construction materials, e.g., reinforcing wire, wire paper, flashing material, stucco, plaster, cementatious compositions, staples, nails, insulation boards, weep screeds, and the like. For simplicity, exterior wall system 100 is depicted with a "generic" existing wall system 104 having undefined construction details. When initially formed, existing wall system 104 may be applied to a framing structure 106, and existing wall system 104 includes an exterior wall surface 108 that is normally exposed to the outside elements. Accordingly, exterior wall surface 108 may be textured or otherwise formed for decorative or aesthetic appeal.

In accordance with a preferred practical embodiment, components of restoration system 102 are applied to existing exterior wall system 104 layer by layer, beginning with a water resistant membrane layer 110. Existing exterior wall system 104 (or portions thereof) may be replaced, repaired, treated, or otherwise modified before water resistant membrane layer 110 is affixed to exterior wall surface 108. Membrane layer 110 provides a water resistant barrier between restoration system 102 and existing exterior wall system 104; membrane layer 110 also prevents water from reaching framing structure 106. In practice, membrane layer 110 is formed by spraying a thin coat of an appropriate material over exterior wall surface 108. Membrane layer 110 is preferably formed from an acrylic based material that becomes water resistant and somewhat flexible when dry. For example membrane layer 110 may be formed from a material known as Kratos red stop in the construction industry. The thickness of membrane layer 110 (when dry) is approximately 0.008 inch. The normal drying time for Kratos red stop is approximately 24 hours at 72 degrees Fahrenheit and 55% relative humidity.

Restoration system 102 also includes a base coat layer 112 formed over water resistant membrane layer 110. In the preferred practical embodiment, base coat layer 112 is reinforced with a reinforcing element 114 embedded in base coat layer 112. Reinforcing element 114 provides structural reinforcement for base coat layer 112, particularly while base coat layer 112 is being applied to membrane layer 110. In accordance with one practical embodiment, base coat layer 112 is an acrylic based cementatious composition. The particular material used for base coat layer 112 may be selected for its ability to effectively attach to the other layers in restoration system 102 and for its water resistant properties. In most applications, base coat layer 112 is at least three-eighths of an inch thick. Of course, the thickness may vary to accommodate the condition of existing exterior wall system 104 and/or the desired exterior appearance and texture of restoration system 102.

As described in more detail below in connection, with FIG. 5*a*. reinforcing element 114 is attached before base coat layer 112 is applied. In the preferred embodiment, reinforcing element 114 is a wire mesh (informally referred to as "lathing wire") formed of 20 gauge wire; the wire is formed to define a grid of one-inch circles or rounded squares. Reinforcing element 114 is held in an offset position relative to existing exterior wall surface 108 and such that is stands away from water resistant membrane layer 110. Thereafter, the wet base coat material is applied over membrane layer 110 such that reinforcing element 114 is embedded in the base coat material. Base coat layer 112 may be applied by hand or by a suitable application machine (such as a spray gun). The base coat material is evenly deposited over the surface of the wall until the desired depth has been reached. The newly applied base coat layer 112 is left to dry for an appropriate time period, which is nominally 24 hours under good weather conditions.

After base coat layer 112 has adequately dried and water cured as needed, a finish coat layer 116 is applied over base coat layer 112 with 100% coverage. In accordance with one practical embodiment, finish coat layer 116 is a cementations composition. Finish coat layer 116 is applied in a suitable manner to provide the desired exterior texture and appearance. For example, common finish textures include a Spanish lace texture, which is relatively rough in appearance, a spray or dash texture, which has a relatively intermediate roughness, and a sand finish, which is relatively smooth in texture. In most applications, finish coat layer 116 is at least one-eighth of an inch thick (in accordance with current building codes). Of course, the thickness may vary to accommodate the desired exterior appearance and texture of restoration system 102.

The wet finish coat material is applied over base coat layer 112 by hand or by a suitable application machine (such as a spray gun). The finish coat material is evenly deposited over the surface of the wall until the desired depth has been reached. The newly applied finish coat layer 116 is left to cure for an appropriate time period to achieve a pH of 10 or below (which is nominally 72 hours under good weather conditions).

After finish coat layer 116 has adequately cured, a sealant layer 118 is applied over finish coat layer 116. In accordance with one practical embodiment, sealant layer 118 is a deep penetrating water repellant forming a hydrophobic barrier beneath the surface of the restoration system. Sealant layer 118 remains vapor permeable and "breathable" when dry. The sealant layer 118 is applied by "flooding" the wall. This is achieved by first misting the surface, then immediately flooding the surface until the sealant material begins to run down the vertical wall approximately 6–10 inches. The wet sealant layer material is applied over finish coat layer 116 by hand or by a suitable application machine (such as a spray gun). The newly applied sealant layer 118 is left to dry for an appropriate time period, which is nominally 48 hours under good weather conditions.

After sealant layer 118 has adequately dried, a final coat layer 120 may be applied over sealant layer 118. In accordance with one practical embodiment, final coat layer 120 is an acrylic based exterior finish coating. Final coat layer 120 may be colored for aesthetic reasons and it may include additional water-resistant components. In most applications, final coat layer 120 is approximately 0.006 inch thick (measured wet). The final coat material is applied over sealant layer 118 by hand or by a suitable application machine (such as a spray gun). The newly applied final coat layer 120 is left to dry for an appropriate time period, which is nominally 48 hours under good weather conditions.

Ultimately, restoration system 102 serves as a retrofit exterior wall construction that covers existing exterior wall surface 108. Thus, even if the underlying existing exterior wall system 104 includes latent defects, restoration system 102 will maintain its integrity and appearance.

Figure 2:
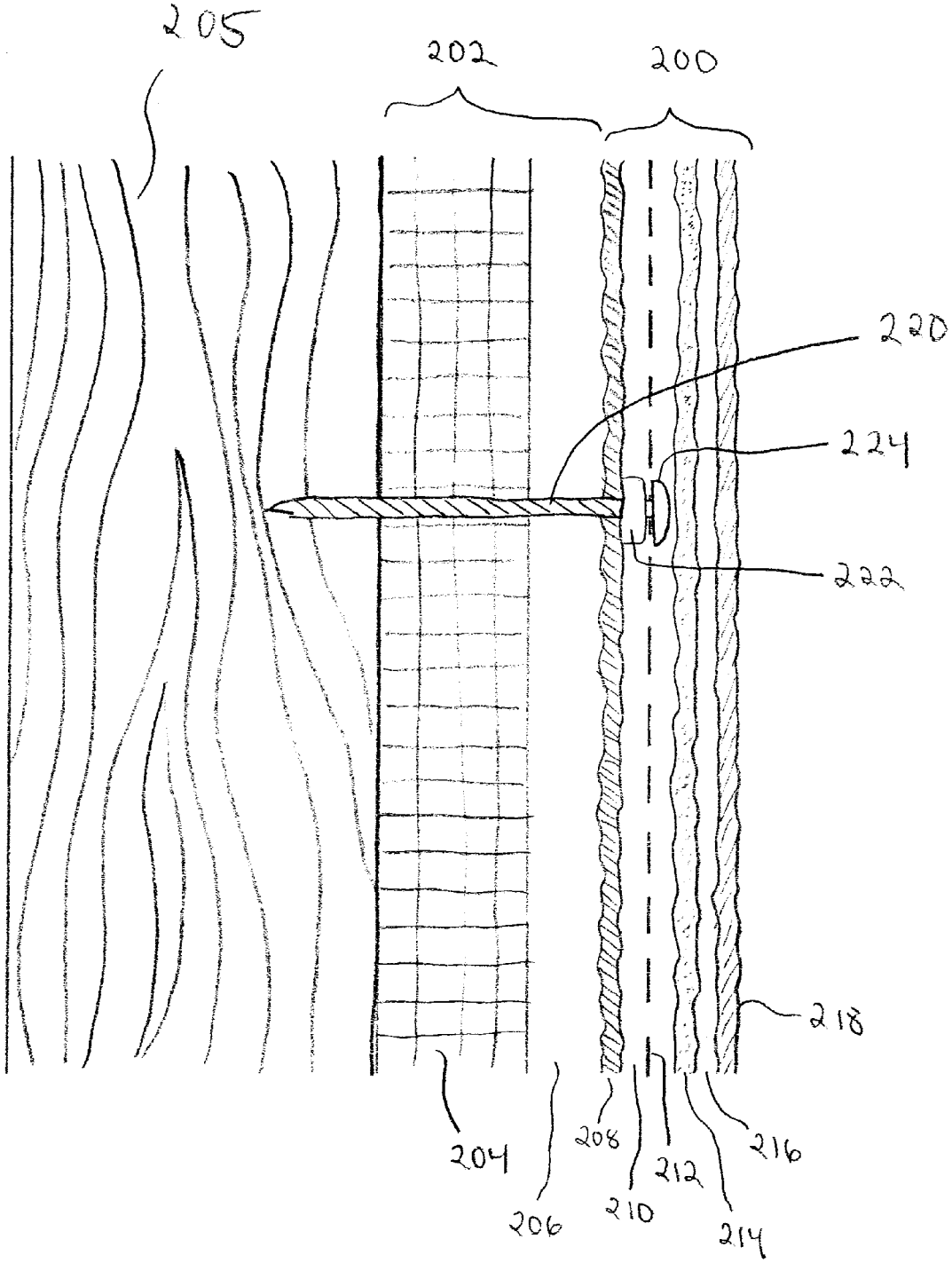
FIG. 2 is a cross-sectional view of a portion of an exterior wall restoration system applied to an existing one coat wall system.

FIG. 2 is a cross-sectional view of a portion of an exterior wall restoration system 200 applied to an existing one coat wall system 202. As mentioned above, the relative dimensions of the wall components are not shown to scale in FIG. 2. Existing one coat wall system 202 generally includes an insulation board 204 (which is typically one inch thick) and a base coat 206. Insulation board 204 is attached to a framing structure 205 of the building (for convenience, only one stud of framing structure 205 is shown in FIG. 2). Although not shown as a distinct component, existing one coat wall system 202 may also include a finish coat over base coat 206.

As described above in connection with FIG. 1, restoration system 200 includes a water resistant membrane layer 208 affixed to the exterior surface of existing wall system 202, a base coat layer 210 formed over membrane layer 208, a reinforcing element 212 embedded in base coat layer 210, a finish coat layer 214 formed over base coat layer 210, a sealant layer 216 formed over finish coat layer 214, and a final coat layer 218 formed over sealant layer 216. Final coat layer 218 is the outermost layer of restoration system 200; final coat layer 218 serves as the exposed exterior layer.

FIG. 2 illustrates one example attachment technique for reinforcement element 212. In this example embodiment, restoration system 102 utilizes a number of furring fasteners 220 for holding reinforcing element 212 in an offset position relative to the existing exterior wall surface (or relative to membrane layer 208). As shown in FIG. 2, furring fastener 220 passes through the existing exterior wall surface, base coat 206, and insulation board 204, and attaches to framing structure 205. In practice, furring fastener 220 may include a drill point and a threaded shank that enables the installer to screw furring fastener 220 directly through existing exterior wall system 202 and into framing structure 205. The length of furring fastener 220 is selected such that it penetrates approximately one inch into framing structure 205 (in one practical embodiment, furring fastener 220 is about 2.5 inches long to accommodate the combined thickness of insulation board 204, base coat 206, and membrane layer 208). Furring fastener 220 may also include an offsetting washer 222 that serves as a spacer between membrane layer 208 and reinforcing element 212. In a typical installation, a portion of reinforcing element 212 is held between washer 222 and the head 224 of furring fastener 220. Thus, a plurality of furring fasteners 220 can be installed throughout the area of restoration system 200 to ensure that reinforcing element 212 is held a uniform distance away from the existing exterior wall surface.

Figure 3:
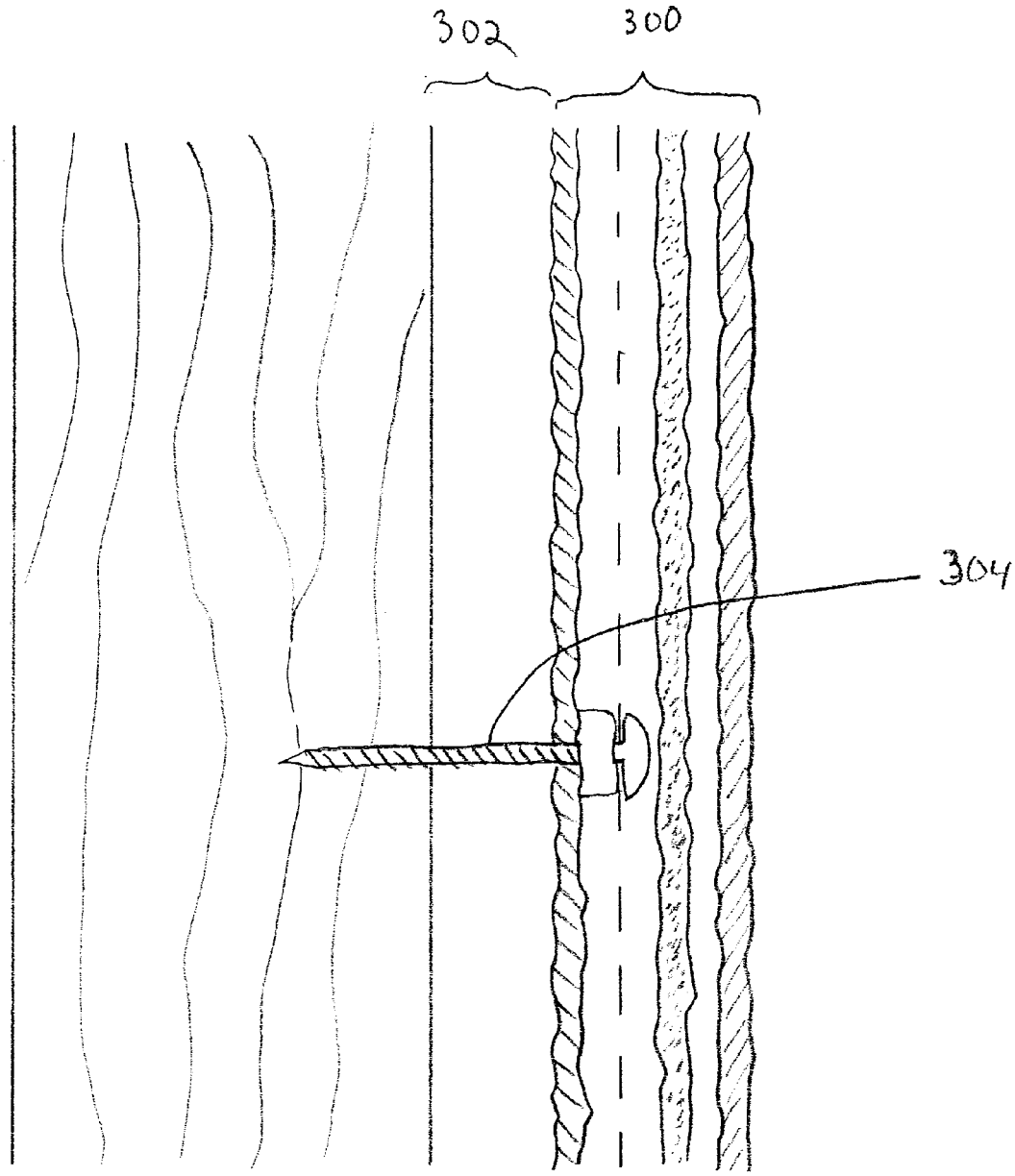
FIG. 3 is a cross-sectional view of a portion of an exterior wall restoration system applied to an existing three coat wall system.

FIG. 3 is a cross-sectional view of a portion of an exterior wall restoration system 300 applied to an existing three coat wall system 302. As mentioned above, the relative dimensions of the wall components are not shown to scale in FIG. 3. Existing three coat wall system 302 includes a scratch coat, a brown coat, and a finish coat (the three coats are shown as a single layer in FIG. 3) having a combined thickness of approximately seven-eighths of an inch. The materials and layers of restoration system 300 are identical to the corresponding materials and layers of restoration system 200. However, furring fastener 304 used in three coat wall system 302 is shorter than furring fastener 220 used in one coat wall system 202 because three coat wall system 302 does not employ an insulation board (in a practical embodiment, furring fastener 304 is approximately 2.0 inches long).

Figure 4:
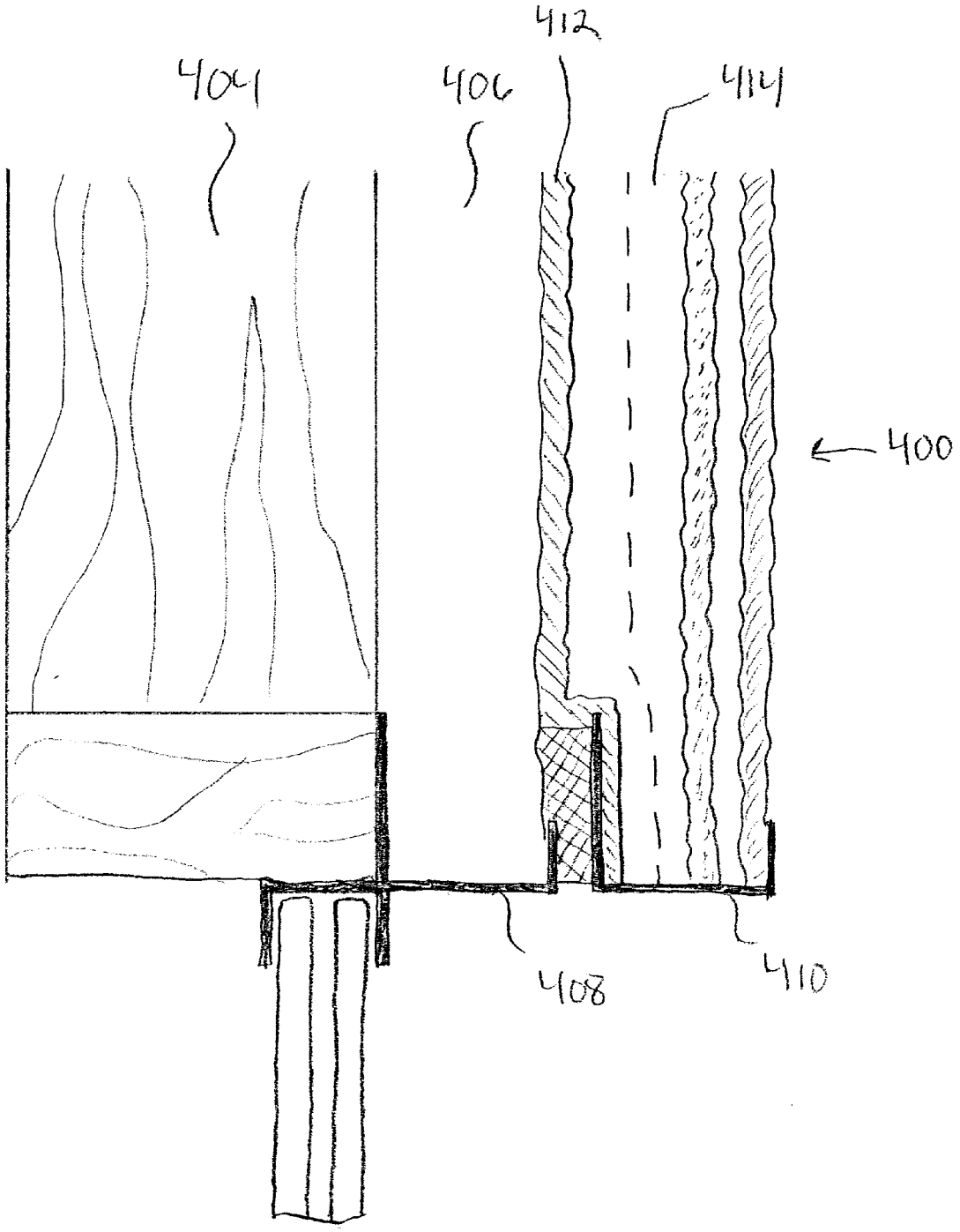
FIG. 4 is a cross-sectional view of a window edge portion of an exterior wall restoration system.

FIG. 4 is a cross-sectional view of a window edge portion of an exterior wall restoration system 400. The structure shown in FIG. 4 (or a suitable equivalent) can be utilized to define window openings, door opening, or other discontinuities in an exterior wall over which a restoration system is applied. The perimeter of an existing window assembly 402 is typically defined by a framing structure 404 surrounding window assembly 402. An existing exterior wall system 406 is attached to framing structure 404 in accordance with conventional techniques. Notably, the edges of wall system 406 surrounding the window opening may be defined by a J-shaped mold or bracket 408 (J-mold 408 need not be utilized in wall constructions having window frame strips or other protruding elements around the perimeter of the window opening). The existing J-mold 408 is attached to framing structure 404 and is configured to retain the various components of existing exterior wall system 406. In practice, J-mold 408 runs around the entire perimeter of the window opening, thus providing a termination for existing exterior wall system 406 at the window head, window sill, and window jambs.

An additional mold or bracket 410 is installed to accommodate the components of restoration system 400. New bracket 410 is preferably sized to accommodate the combined thickness of restoration system 400. In one preferred embodiment, a suitable gasket material (e.g., caulking material or a preformed strip) is located between existing bracket 408 and new bracket 410. Although not shown in FIG. 4, additional sealing materials or components, such as flashing tape, may be employed to prevent water intrusion into existing wall system 406 or restoration system 400. New bracket 410 can be attached to existing wall system 406 and/or to framing structure 404 using any suitable attachment mechanism such as screws or nails. New bracket 410 provides structural support to the terminating edges of restoration system 400, while defining the terminating edges of restoration system 400.

After new bracket 410 has been installed around the perimeter of the window opening, restoration system 400 can be constructed as described above in connection with FIG. 1. As shown in FIG. 4, a water resistant membrane layer 412 is applied to the exterior surface of existing wall system 406. Membrane layer 412 may also be applied to portions of new bracket 410, as shown in FIG. 4. Thereafter, the remaining components of restoration system 400 are applied as described above. The lip of new bracket 410 can serve as a guide for the application of the various layers, particularly the base coat layer 414, which is the thickest layer in restoration system 400.

FIGS. 5*a*–5*e* are cross-sectional views depicting the restoration of a foundation edge portion of an exterior wall system. A typical process for restoring an existing exterior wall construction will be described in connection with these figures. Although FIG. 5 shows a foundation edge portion, the following technique (or portions thereof) may be utilized to restore other portions of an existing wall system, e.g., main wall sections, window sections, corner sections, door sections, or the like.

Figure 5A:
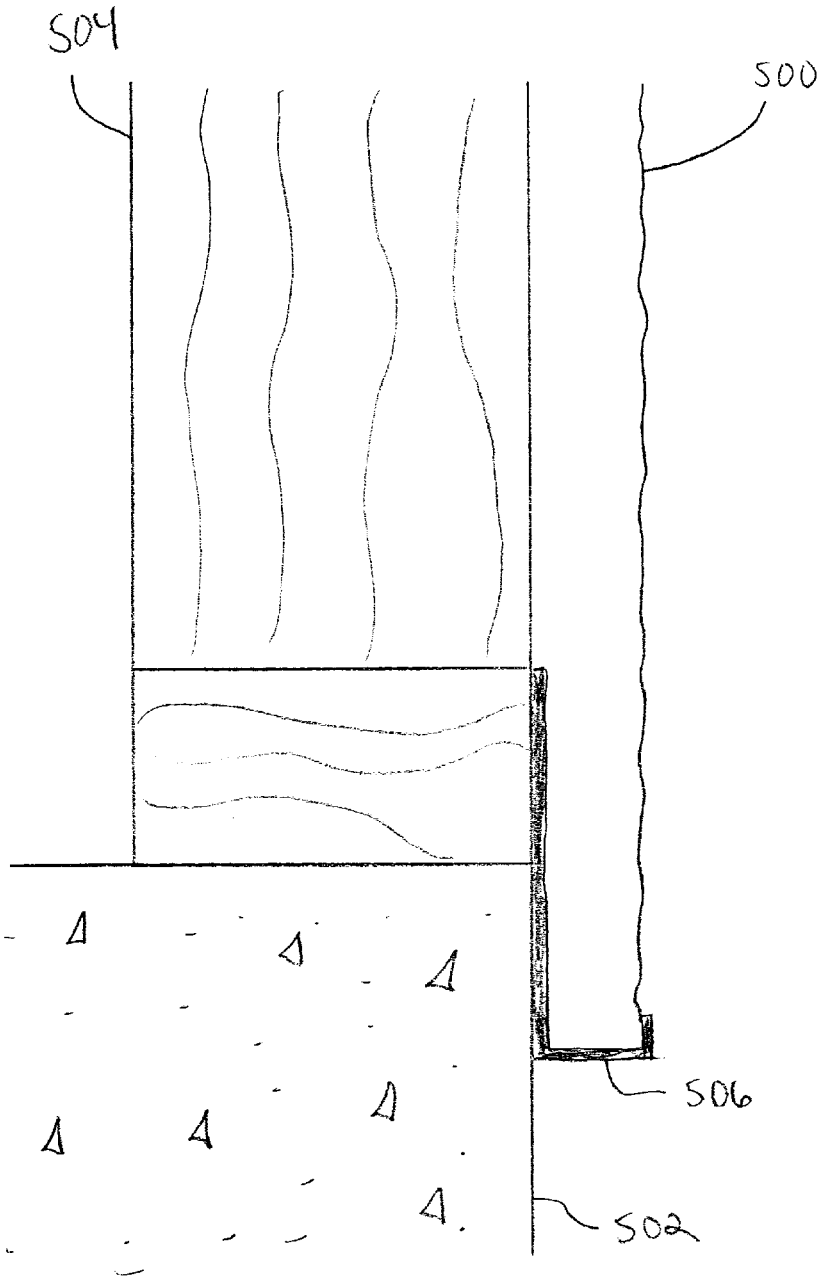
FIGS. 5*a*–5*e* are cross-sectional views depicting the restoration of a foundation edge portion of an exterior wall system.

FIG. 5*a* depicts an existing exterior wall system 500 terminating at a foundation 502. Existing wall system 500 is constructed over a framing structure 504, which may be attached to foundation 502. In accordance with conventional construction techniques, existing wall system 500 employs a weep screed 506 having a depth that accommodates the thickness of existing wall system 500. Although not shown in FIG. 5*a,* the bottom of weep screed 506 includes a number of drainage holes formed therein. Weep screed 506 functions to retain the components of existing wall system 500 and to facilitate drainage of water from within existing wall system 500. Weep screed 506 can be attached to framing structure 504 and/or to foundation 502.

Figure 5B:
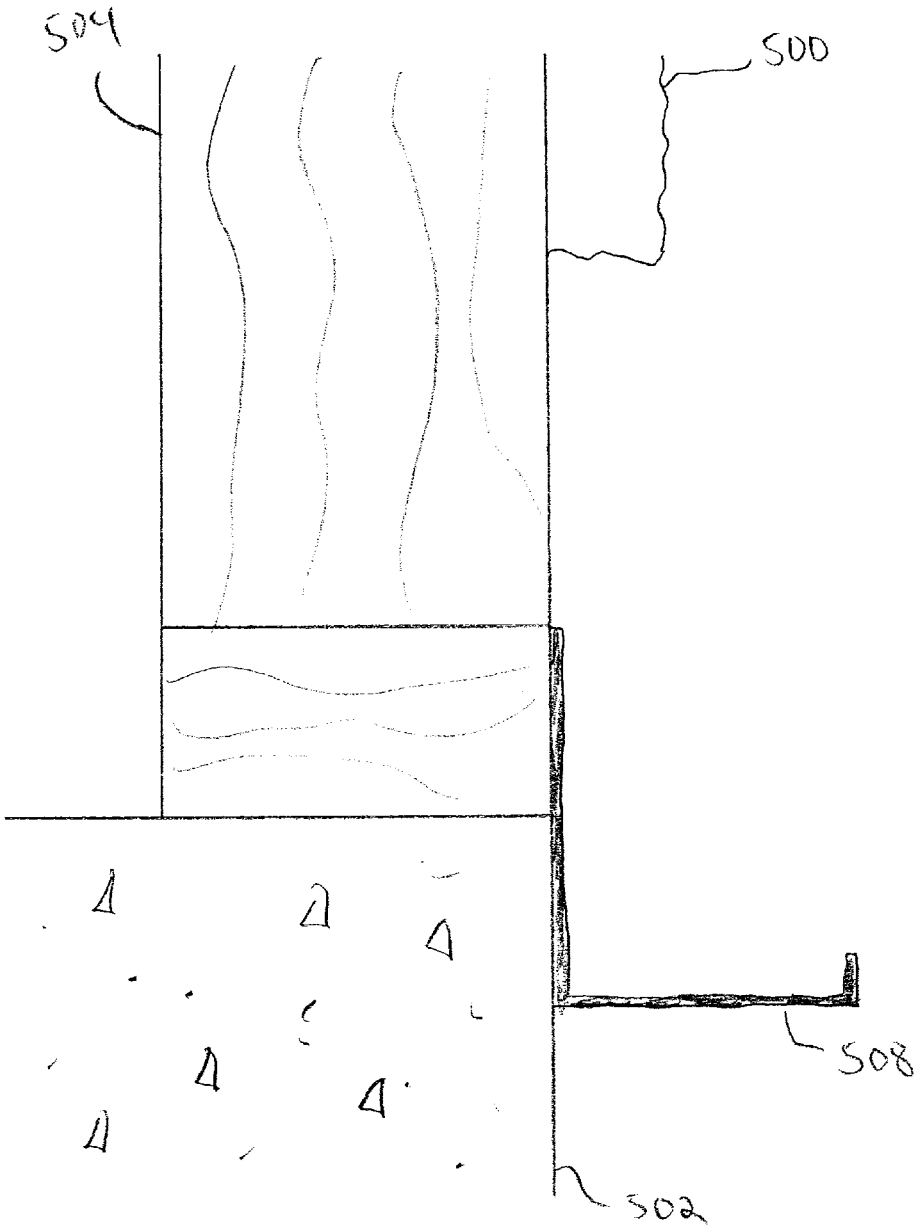

Referring to FIG. 5*b,* to prepare for the construction of the restoration system, weep screed 506 is removed, along with the portion of the existing exterior wall construction 500 covering weep screed 506. If necessary, additional amounts of existing wall construction 500 may be removed to accommodate the application of the restoration system. Damaged or defective portions of existing exterior wall system 500 may also be removed to ensure effective application of the restoration system. Thereafter, a retrofit weep screed 508 is installed to replace weep screed 506. In the preferred practical embodiment, retrofit weep screed 508 has an increased depth, relative to weep screed 506, to accommodate the additional thickness of the restoration system. In one practical embodiment, retrofit weep screed 508 is formed from a vinyl material having high density characteristics that enable it to retain its structural integrity over time. FIG. 5*b* depicts the state of the wall section after removal of a portion of existing exterior wall construction 500 and replacement of the old weep screed 506 with retrofit weep screed 508. Although not shown in the FIG. 5 sequence, any number of additional sealing components or materials may be utilized to ensure that water does not leak into framing structure 504 and/or foundation 502. For example, a sealing membrane, a gasket, flashing, or caulking material may be applied over the junction of framing structure 504 and retrofit weep screed 508 to prevent water leakage down the back side of retrofit weep screed 508.

Figure 5C:
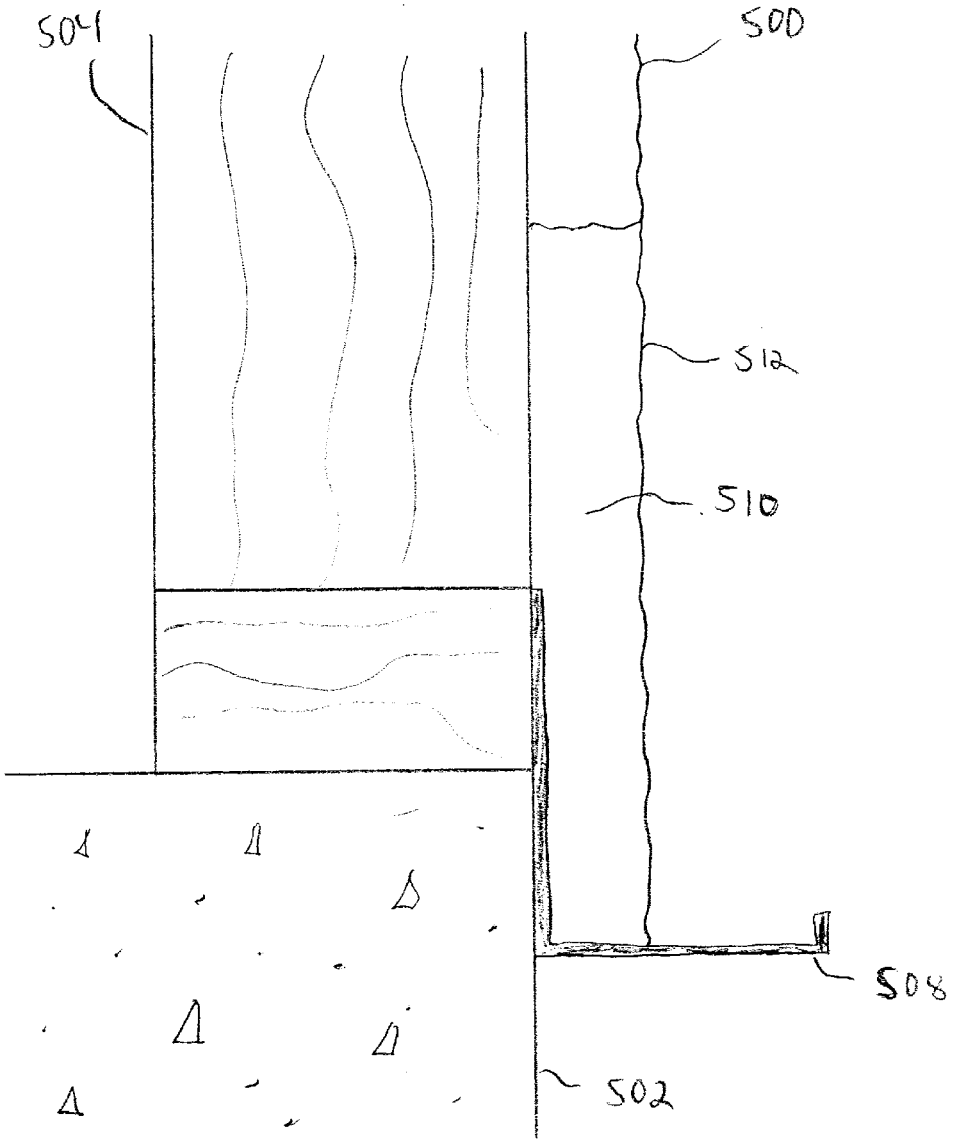

Referring to FIG. 5c, material 510 may be added to replace the removed portion of the existing wall construction. Material 510 may be applied using the same construction techniques as existing exterior wall system 500. For example, if existing wall system 500 is a one coat system, then material 500 may include a section of insulation board, a layer of base coat material, and possibly a finish coat layer. On the other hand, if existing wall system 500 is a three coat system, then material 500 may include wire paper, a scratch coat layer, a brown coat layer, and a finish coat layer. Alternatively, material 500 may include any combination of one or more materials or components that provide an appropriate structural foundation for the restoration system. In accordance with the preferred application process, a suitable exterior surface 512 is created on material 510; exterior surface 512 is aligned with the exterior surface of existing wall system 500.

Figure 5D:
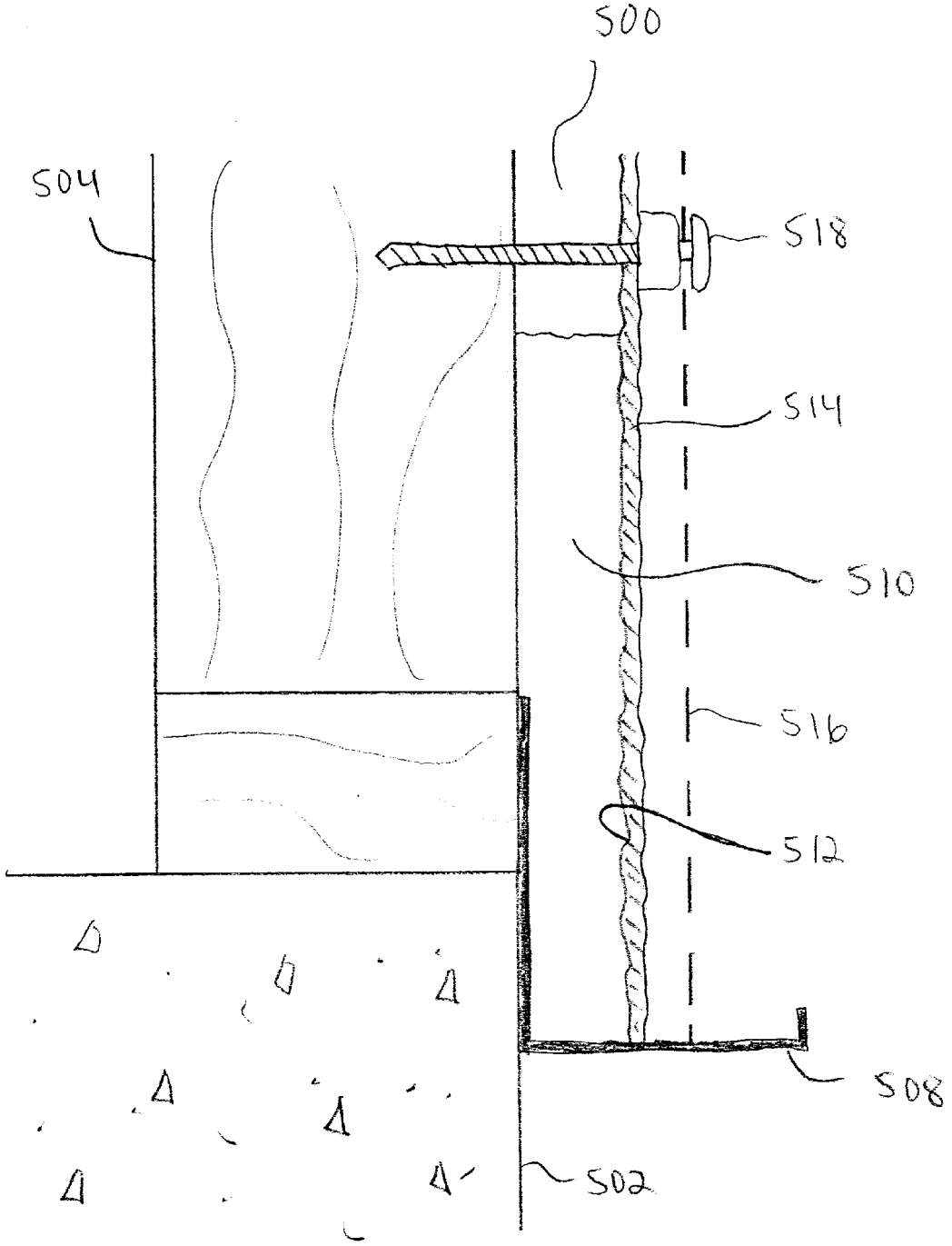

Referring to FIG. 5*d*, a water resistant membrane layer 514 is affixed to the outer surface of existing exterior wall system 500 and, if applicable, to the exterior surface 512 of material 510. In other words, membrane layer 514 is applied over the old sections of existing wall system 500 and over any reconstructed sections of existing wall system 500. Thereafter, a reinforcing element 516 is attached using a number of fasteners 518, as described in more detail above. FIG. 5*d* depicts the state of the wall construction after application of membrane layer 514 and reinforcing element 516. Notably, the offset positioning of reinforcing element 516 relative to membrane layer 514 (as described above in connection with FIG. 2) is clearly shown in FIG. 5*d*. Fasteners 518 may be installed through existing wall construction 500, through material 510, and/or through retrofit weep screed 508, and into framing structure 504 and/or foundation 502.

Figure 5E:
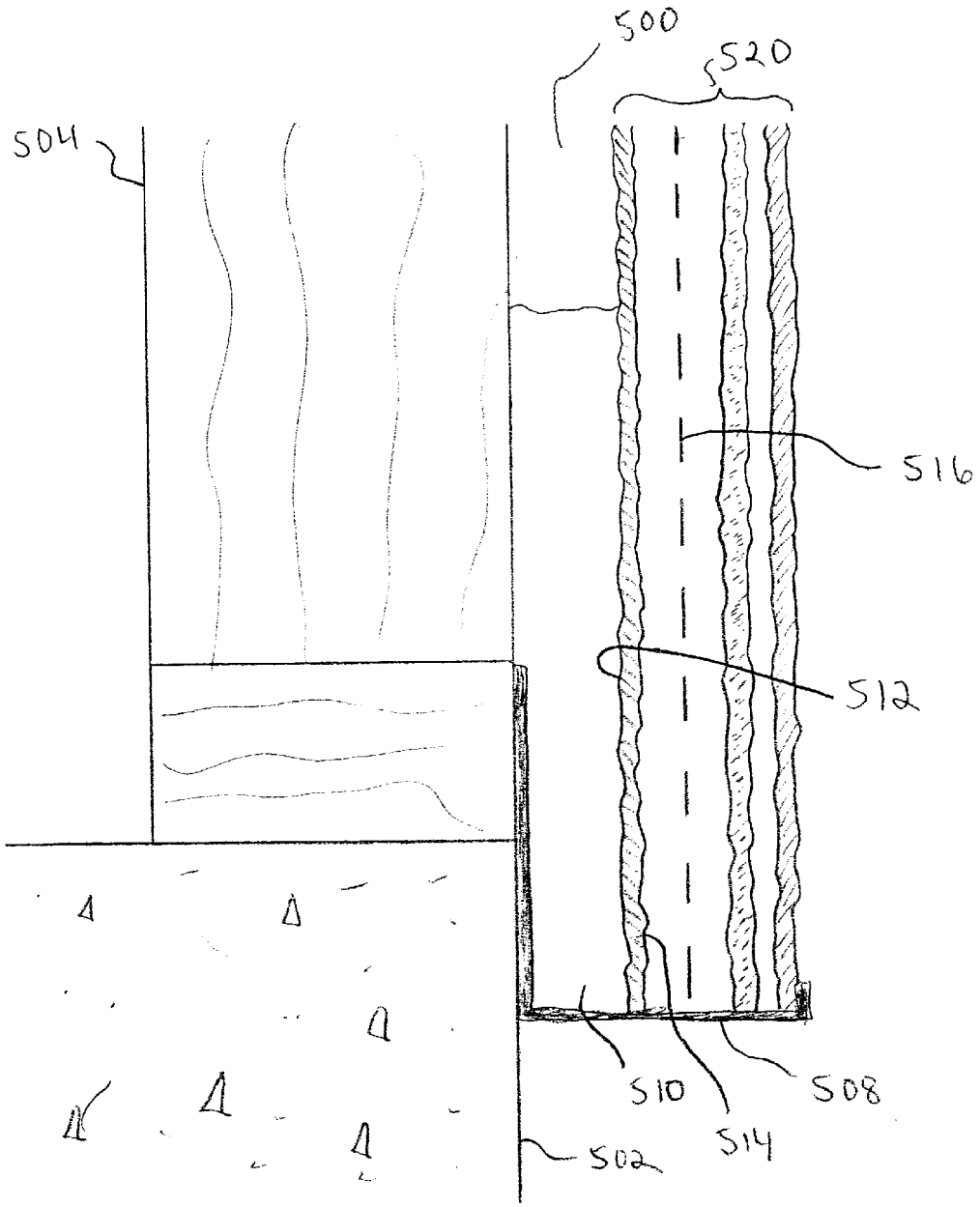

Referring to FIG. 5*e*, the remaining elements and materials can be applied to complete a retrofit exterior wall construction 520 that covers existing exterior wall system 500 and the exterior surface 512 of material 510. As depicted in FIG. 5*e*, the combined thickness of material 510, water resistant membrane layer 514, the base coat layer, the finish coat layer, the sealant layer, and (possibly) the final coat layer does not exceed the depth of retrofit weep screed 508. In this regard, retrofit weep screed 508 functions to support and retain the various components of the restoration system and to facilitate drainage of water that may accumulate in the wall system.

It should be appreciated that the particular implementations shown and described herein are illustrative of the invention and its best mode and are not intended to otherwise limit the scope of the invention in any way. Those skilled in the art having read this disclosure will recognize that changes and modifications may be made to the preferred embodiment without departing from the scope of the present invention. These and other changes or modifications are intended to be included within the scope of the present invention, as expressed in the following claims.

What is claimed is:

1. An exterior wall restoration system for application to an existing exterior wall surface, said exterior wall system comprising:

a water resistant membrane layer affixed to said existing exterior wall surface;

an acrylic base coat layer formed over said water resistant membrane layer;

a reinforcing element embedded in said acrylic base coat layer, said reinforcing element providing structural reinforcement for said acrylic base coat layer;

at least one furring fastener for holding said reinforcing element in an offset position relative to said existing exterior wall surface, wherein at least one furring fastener passes through said existing exterior wall surface and attaches to an existing framing structure; and a finish coat layer formed over said acrylic base coat layer.

2. A method for restoring an existing exterior wall construction having an existing exterior wall surface, said method comprising:

affixing a water resistant membrane layer to said existing exterior wall surface;

holding a reinforcing element in an offset position relative to said existing exterior wall surface, wherein said holding step comprises: passing at least one furring fastener through said existing exterior wall surface and attaching said at least one furring fastener to an existing framing structure;

applying an acrylic base coat layer over said water resistant membrane layer such that said reinforcing element is embedded in said acrylic base coat layer, said reinforcing element providing structural reinforcement for said acrylic base coat layer; and applying a finish coat layer over said acrylic base coat layer.

3. A method for restoring an existing exterior wall construction having an existing exterior wall surface and an existing weep screed having a first depth, said method comprising:

removing a portion of said existing exterior wall construction covering said existing weep screed;

replacing said existing weep screed with a retrofit weep screed having a second depth that exceeds said first depth;

adding material to replace said portion of said existing exterior wall construction;

creating, on said material, an exterior surface aligned with said existing exterior wall surface;

affixing a water resistant membrane layer to said existing exterior wall surface and to said exterior surface;

applying a base coat layer over said water resistant membrane layer; and applying a finish coat layer over said acrylic base coat layer.

4. A method according to claim 3, further comprising:

before applying said base coat layer, holding a reinforcing element in an offset position relative to said existing exterior wall surface and relative to said exterior surface; and embedding said reinforcing element in said base coat layer.

5. A method according to claim 4, wherein said holding step comprises:

passing at least one furring fastener through said existing exterior wall surface; and attaching said at least one furring fastener to an existing framing structure.

6. A method according to claim 3, wherein the combined thickness of said material, said water resistant membrane, said base coat layer and said finish coat layer does not exceed said second depth of said retrofit weep screed.

7. A method for restoring an existing exterior wall construction having an existing exterior wall surface, said method comprising:

removing a portion of said existing exterior wall construction;

adding material to replace said portion of said existing exterior wall construction:

creating, on said material, an exterior surface aligned with said existing exterior wall surface; and covering said existing exterior wall surface and said exterior surface with a retrofit exterior wall construction, wherein said covering step comprises:

affixing a water resistant membrane layer to said existing exterior wall surface and to said exterior surface, applying a base coat layer over said water resistant membrane layer and applying a finish coat layer over said acrylic base coat layer.

8. A method according to claim 7, claim further comprising:

before applying said base coat layer, holding a reinforcing element in an offset position relative to said existing exterior wall surface and relative to said exterior surface; and embedding said reinforcing element in said base coat layer.

9. A method according to claim 8, wherein said holding step comprises:

passing at least one furring fastener through said existing exterior wall surface; and attaching said at least one furring fastener to an existing framing structure.

10. A method for restoring an existing exterior wall construction having an existing exterior wall surface, said method comprising:

removing a portion of said existing exterior wall construction;

adding material to replace said portion of said existing exterior wall construction;

creating, on said material, an exterior surface aligned with said existing exterior wall surface;

affixing a water resistant membrane layer to said existing exterior wall surface;

holding a reinforcing element in an offset position relative to said existing exterior wall surface;

applying an acrylic base coat layer over said water resistant membrane layer such that said reinforcing element is embedded in said acrylic base coat layer, said reinforcing element providing structural reinforcement for said acrylic base coat layer; and applying a finish coat layer over said acrylic base coat layer.

11. A method according to claim 10 wherein said affixing step affixes said water resistant membrane layer to said exterior surface.

* * * * *